US006558178B2

(12) United States Patent
Nakamura

(10) Patent No.: US 6,558,178 B2
(45) Date of Patent: May 6, 2003

(54) WATERPROOF CONNECTOR

(75) Inventor: Hideto Nakamura, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/948,048

(22) Filed: Sep. 7, 2001

(65) Prior Publication Data

US 2002/0031933 A1 Mar. 14, 2002

(30) Foreign Application Priority Data

Sep. 8, 2000 (JP) ..... 2000-273470

(51) Int. Cl.[7] ..... H01R 13/52
(52) U.S. Cl. ..... 439/271; 439/587; 439/589
(58) Field of Search ..... 439/271, 587, 439/589

(56) References Cited

U.S. PATENT DOCUMENTS 4,973,859 A 11/1990 Shodai
5,197,898 A * 3/1993 Nagamine ..... 439/271
5,556,294 A * 9/1996 Hofmeister et al. ..... 439/271
5,613,867 A * 3/1997 Hotea ..... 439/271
5,957,715 A * 9/1999 Fukuda ..... 439/271
6,045,383 A * 4/2000 Fujiwara ..... 439/271

FOREIGN PATENT DOCUMENTS

| | | |
|---|---|---|
| EP | 964 481 | 12/1999 |
| EP | 967 688 | 12/1999 |
| JP | 63-257187 | 10/1988 |

* cited by examiner

*Primary Examiner*—Tho D. Ta
(74) *Attorney, Agent, or Firm*—Banner & Witcoff, Ltd.

(57) ABSTRACT

The invention provides a waterproof connector in which surplus space is removed, and the connector is reduced in size. A housing of a waterproof connector 1 comprises an inner housing 3 and an outer housing 2. A sealing ring 14 is fitted completely into an attachment groove 13 formed in an outer wall face 4A of a terminal housing member 4 of the inner housing 3. As a result, the sealing ring 14 can be provided without increasing the outer circumference of a fitting space 10, and the waterproof connector 1 can be miniaturized. Furthermore, the fitting space 10 has no surplus space corresponding to the thickness of the sealing ring 14. The two housings 2 and 3 are joined together after the sealing ring 14 has been fitted to the inner housing 3. Consequently, the sealing ring 14 can be attached easily.

14 Claims, 6 Drawing Sheets

OIPE JC34
NOV 1 3 2002
PATENT & TRADEMARK OFFICE

WATERPROOF CONNECTOR

TECHNICAL FIELD

The present invention relates to a waterproof electrical connector.

BACKGROUND TO THE INVENTION

A conventional connector 101 is shown in FIGS. 10 and 11 of this specification. This conventional connector is a waterproof connector employing a configuration whereby a space between a terminal housing member 103 and a skirt member 111 of a corresponding connector 110 is sealed by a sealing ring 102. This sealing ring 102 is annular and is housed within a fitting space 104. When the connector 101 is to be fitted to the corresponding connector 110, the skirt member 111 is inserted into the fitting space 104, and the sealing ring 102 is gripped between inner walls of the skirt member 111 and outer walls of the terminal housing member 103, thereby waterproofing the interior of the connector.

In the above configuration, the outer circumference of the fitting space 104 must be increased to the extent of the thickness of the sealing ring 102, thereby requiring the connector 101 to be larger in size. Furthermore, a space 105 is formed within the fitting space 104. This corresponds to the space between an anterior end 102A of the sealing ring 102 and a fitting face 112 of the corresponding connector 110, and has the thickness of the sealing ring 102. This space 105 is surplus space which serves no fiction for the connector. If removed, the size of the connector could be reduced.

The present invention has taken the above problem into consideration, and aims to present a waterproof connector wherein the surplus space is removed, and the connector can thereby have a smaller size.

SUMMARY OF THE INVENTION

According to the invention there is provided a waterproof connector comprising a terminal accommodating member adapted to house a terminal fitting, a hood surrounding said accommodating member, a fitting space formed between said hood and accommodating member, a corresponding connector having a tubular mouth being insertable into said fitting space, and a waterproofing member being provided at said fitting space, one of the inner and outer circumferential faces of said waterproofing member forming a sealing face with the corresponding connector characterized in that one of an inner wall face of said hood and an outer wall face of said accommodating member is provided with a recess to house said waterproofing member. Such a connector has no dead space, and can easily be miniaturized.

In a preferred embodiment the connector is in two part form, the accommodating member and hood being moulded separately and assembled after positioning of the waterproofing member. Such an arrangement permits convenient assembly of the components.

The waterproofing member preferably fits precisely in the associated recess without clearance, and radial faces thereof may provide sealing against relatively movable parts of an assembled connector. Furthermore this arrangement provides for easy insertion and retention of the waterproofing member, and with suitable attention to tolerances, may exert an end load on the waterproofing member with a consequent bulging in the radial direction, thus improving the waterproofing ability thereof.

BRIEF DESCRIPTION OF DRAWINGS

Other features of the invention will be apparent from the following description of several preferred embodiments shown by way of example only in the accompanying drawings in which.

DESCRIPTION OF PREFERRED EMBODIMENTS

Figure 1:
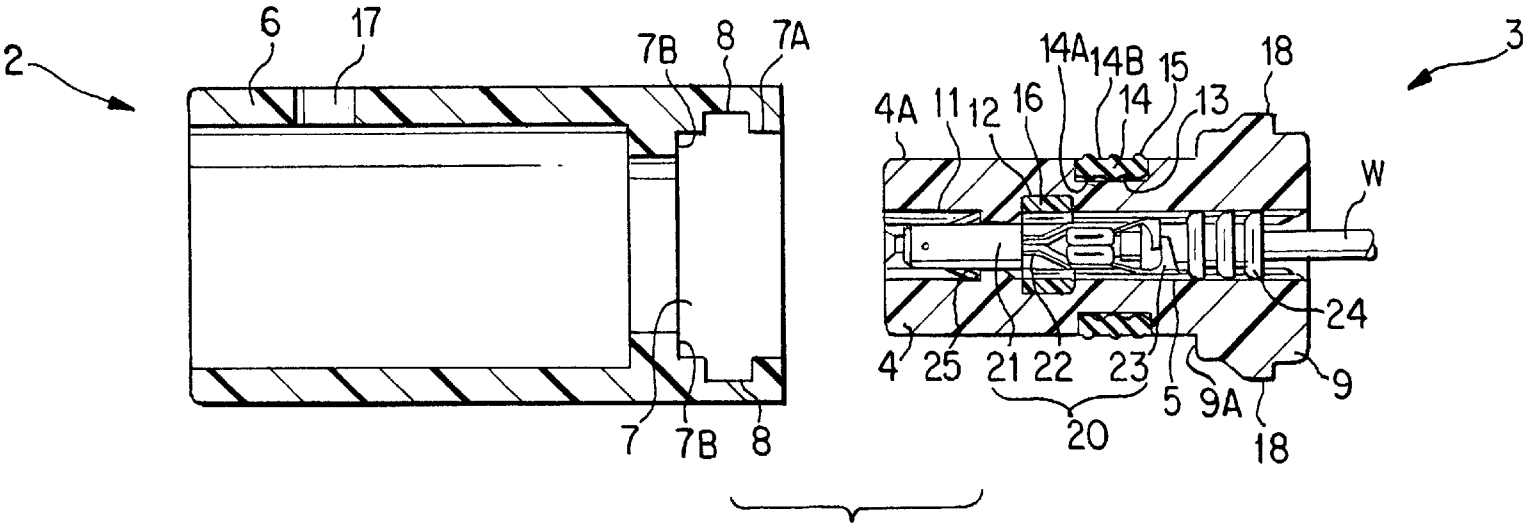
FIG. 1 is a disassembled side cross-sectional view of a waterproof connector of a first embodiment.
Figure 2:
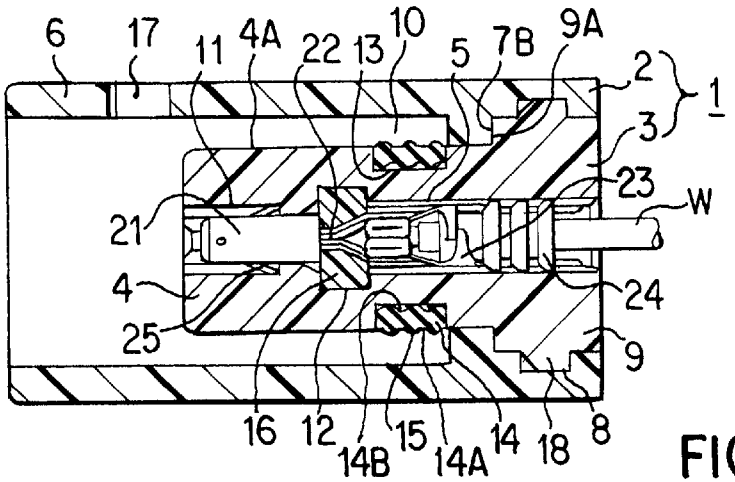
FIG. 2 is a side cross-sectional view showing the waterproof connector of the first embodiment in a joined state.
Figure 3:
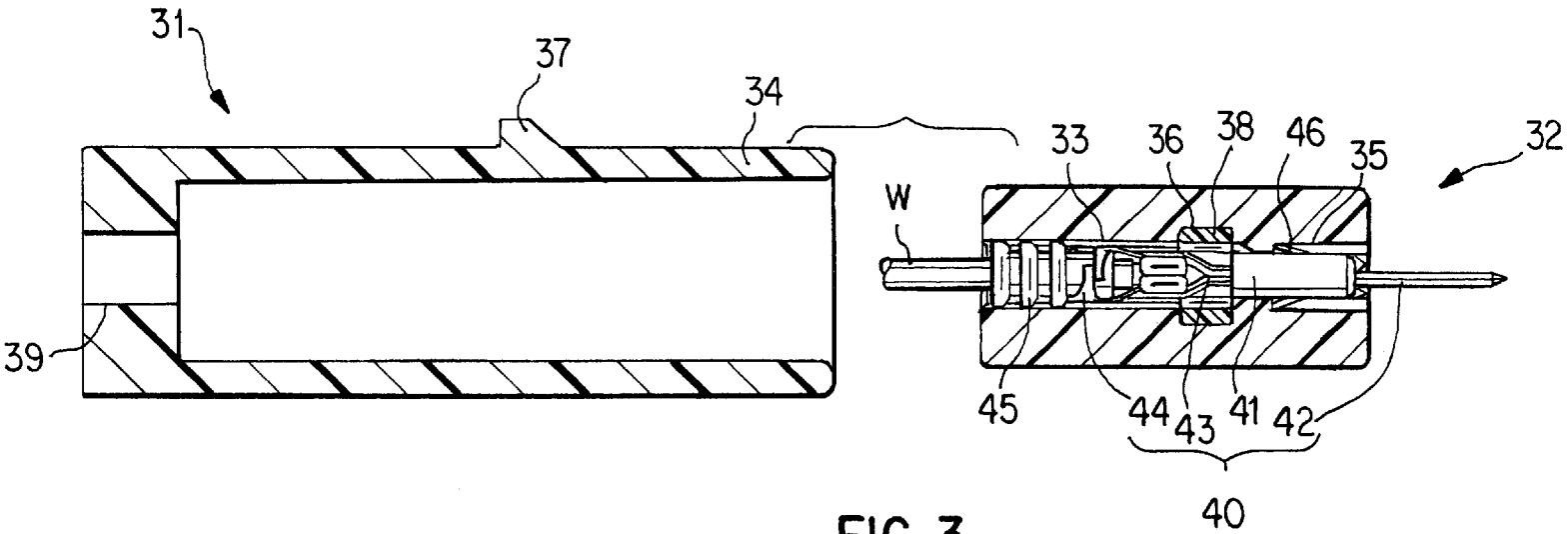
FIG. 3 is a disassembled side cross-sectional view of a corresponding connector of both embodiments.
Figure 4:
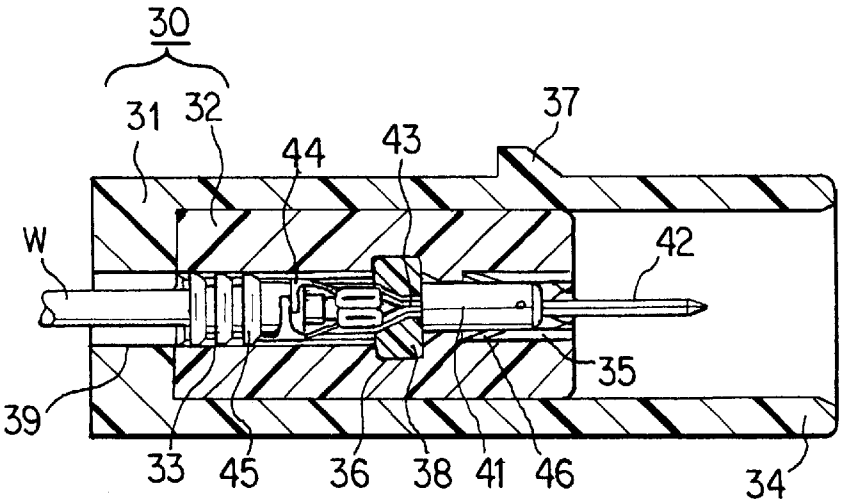
FIG. 4 is a side cross-sectional view of the corresponding connector of both embodiments in a joined state.
Figure 5:
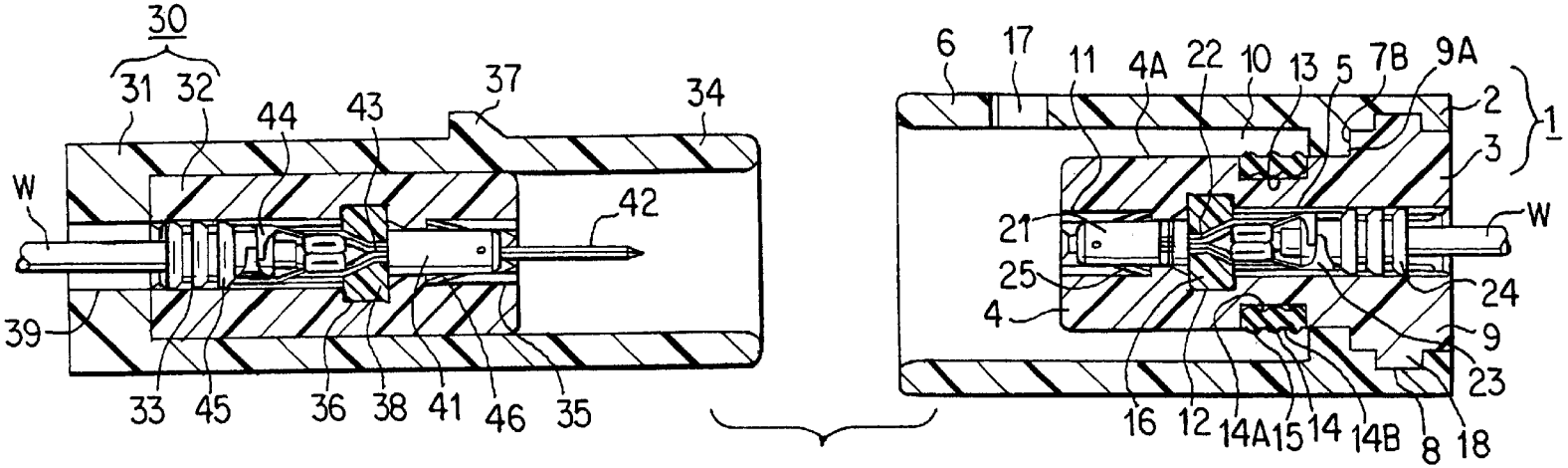
FIG. 5 is a side cross-sectional view of the waterproof connector of the first embodiment and the corresponding connector prior to being fitted together.

A first embodiment of the present invention is described below with the aid of FIGS. 1 to 6. In the description below, mutually fitting sides of a waterproof connector 1 and a corresponding connector 30 are considered to be anterior sides (see FIG. 5).

The waterproof connector 1 is female, and comprises an inner housing 3 fitted into an outer housing 2. A terminal housing member 4, which is capable of being housed within a skirt member 34 of the corresponding connector 30, is provided in the inner housing 3. A female terminal fitting 20 is housed within a cavity 5 formed within the terminal housing member 4 (see FIGS. 1 and 2).

The outer housing 2 of the waterproof connector 1 has an approximately tubular shape in which both ends in the anterior-posterior direction are open. An anterior end portion of the outer housing 2 forms a hood 6 capable of housing the corresponding connector 30. A posterior end portion of the outer housing 2 forms a housing hole 7 capable of housing a posterior end portion of the inner housing 3. A posterior end portion of the housing hole 7 forms a wide diameter member 7A which is wider in diameter than the narrowest portion of the housing hole 7. A pair of concave retaining recesses 8 are formed in upper and lower faces of the housing hole 7. These engage with retaining protrusions 18 of the inner housing 3 after the two housings 2 and 3 have been fitted together.

The inner housing 3 has a cross-sectionally tubular shape and has dimensions whereby it fits precisely within the housing hole 7. The inner housing 3 is fitted from the posterior into the outer housing 2, the anterior end portion of the inner housing 3 protruding into the hood 6. A flange member 9, which is provided at a posterior end of the inner housing 3, extends across the entire opening of the wide diameter member 7A. A pair of retaining protrusions 18 are provided on upper and lower faces of the flange member 9, these engaging with the retaining recesses 8 of the outer housing 2.

The cavity 5, for receiving the female terminal fitting 20, is formed within the terminal housing member 4 of the inner housing 3. An upper and lower pair of lance retaining grooves 11, for retaining lances 25 formed on the female terminal fitting 20, are formed in the vicinity of anterior ends of the cavities 5. A retainer through hole 12 passes through left and right side faces of the inner housing 3 at a location to the posterior of the lance retaining grooves 11. This retainer through hole 12 is formed in upper and lower faces of the cavity 5.

A concave attachment groove 13 is formed around the entire circumference of an outer wall face 4A of the terminal housing member 4 at a location slightly towards the posterior relative to the centre thereof (in the anterior-posterior direction). The sealing ring 14, which is annular and is made from a resilient material such as rubber, is fitted into this attachment groove 13. An outer circumference face 14B of the sealing ring 14 forms an approximately unified face with the outer wall face 4A of the terminal housing member 4. Furthermore, a plurality of lips 15 are formed on an inner circumference face 14A of the sealing ring 14 and on the outer circumference face 14B thereof, as illustrated.

An anterior portion of the female terminal fitting 20, which is attached to the inner housing 3, forms an angular pillar-like connector member 21 into which a tab 42 of a corresponding male terminal fitting 40 can be fitted. A posterior portion of the female terminal fitting 20 forms a barrel member 23 that is joined to the female terminal fitting 20 via a joining member 22 and crimps an end of an electric wire W. In addition to the end of the electric wire W, a waterproof rubber stopper 24 is also crimped by the barrel member 23. This waterproof rubber stopper 24 waterproofs the cavity 5 by fitting tightly with inner walls thereof. Moreover, the pair of lances 25 are formed on upper and lower faces of the connecting member 21. These lances 25 have a cantilevered shape whose base end is at the anterior, and are capable of moving slightly in an up-down direction.

The female terminal fitting 20 is maintained in a first retained state by means of posterior ends of the lances 25 catching with posterior walls of the lance retaining grooves 11 of the cavity 5. Then a C-shaped side retainer 16 is pushed in from the side through the retainer through hole 12, an inner side of the C-shape of the side retainer 16 gripping the connecting member 21 of the female terminal fitting 20, and an anterior face of the side retainer 16 making contact with a posterior end of the connecting member 21. This doubly retains the female terminal fitting 20.

Next, the corresponding connector 30 will be described. The corresponding connector 30 is a male connector wherein an inner housing 32 is fitted into an outer housing 31, and a male terminal fitting 40 is housed within a cavity 33 formed in the inner housing 32 (see FIGS. 3 and 4).

The outer housing 31 has an approximately tubular shape. The skirt member 34, which can fit into the waterproof connector 1, is formed at an anterior end thereof. The inner housing 32 is housed within this skirt member 34. Furthermore, an electric wire through hole 39, through which an electric wire of the male terminal fitting 40 can be inserted, is formed in a posterior end portion of the outer housing 31.

The inner housing 32 has a cross-sectional block shape and has dimensions whereby it fits precisely into the skirt member 34. The cavity 33, which houses a main body 41 of the male terminal fitting 40 (to be described), is provided within the inner housing 32. When the inner housing 32 has been fitted into the skirt member 34, the cavity 33 connects with the electric wire through hole 39. As in the case of the cavity 5 of the waterproof connector 1, upper and lower faces of the cavity 33 are provided with lance retaining grooves 35 and a retainer through hole 36.

The male terminal fitting 40 is provided with the tab 42 which protrudes from an anterior end of the box-shaped main body 41, and which makes contact with the female terminal fitting 20 of the waterproof connector 1. As in the case of the female terminal fitting 20, a barrel member 44 is provided at a posterior end of the male terminal fitting 40, being joined thereto via a joining member 43. This barrel member 44 crimps the electric wire W and an end of a waterproof rubber stopper 45. When the male terminal fitting 40 is attached within the cavity 33, lances 46 formed on the main body 41 catch within the lance retaining grooves 35 of the cavity 33, thereby performing a first retaining of the male terminal fitting 40; then a side retainer 38 doubly retains this male terminal fitting 40.

Next, the operation and effects of the waterproof connector 1, configured as described above, will be described.

When the waterproof connector 1 is to be assembled, the sealing ring 14 is fitted into the attachment groove 13 formed in the inner housing 3. Next, the female terminal fitting 20 is inserted from the posterior into the cavity 5 until it reaches its correct position; it is retained in this position by the lances 25 and the side retainer 16. Then the inner housing 3 is inserted into the outer housing 2 from its posterior side, an anterior end 9A of the flange member 9 striking against a retaining wall 7B, and the retaining protrusions 18 engaging with the retaining holes 8. This maintains the inner housing 3 in a latched state. When the two housings 2 and 3 are in a joined state, a fitting space 10 is formed in the space between the anterior portion of the inner housing 3 and the hood 6. The skirt member 34 of the corresponding connector 30 can be fitted into this fitting space 10.

In this manner, the housing of the waterproof connector 1 is separated into the inner housing 3 and the outer housing 2, the sealing ring 14 first being fitted into the attachment groove 13 formed in the inner housing 3, then these two housings 2 and 3 being joined together. Consequently, the sealing ring 14 can be fitted easily compared to the case where the housing is not formed as separate components.

Figure 6:
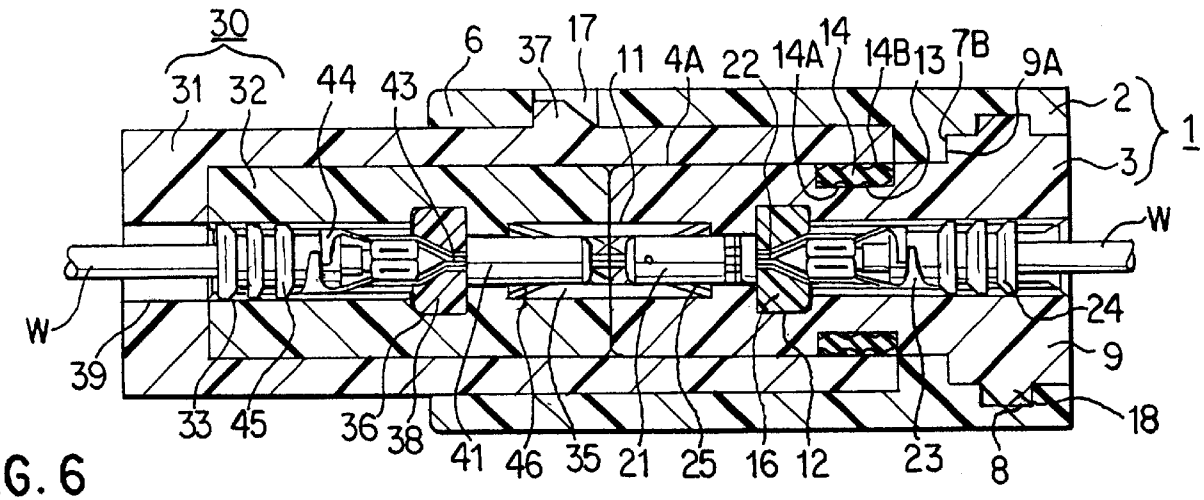
FIG. 6 is a side cross-sectional view of the waterproof connector of the first embodiment and the corresponding connector in a fitted state.

When the waterproof connector 1 is fitted to the corresponding connector 30, the skirt member 34 of the corresponding connector 30 is inserted into the fitting space 10 of the waterproof connector 1. As shown in FIG. 6, after the two connectors 1 and 30 have been correctly fitted together, the male and female terminal fittings 20 and 40 make contact, and a locking member 37 provided on the skirt member 34 of the corresponding connector 30 engages with a groove member formed in the hood 6 of the waterproof connector 1, this maintaining the two connectors 1 and 30 in an unremovable state. Furthermore, the lips 15 on the inner circumference face 14A and the outer circumference face 14B of the sealing ring 14 are pushed resiliently against the attachment groove 13 and an inner wall face of the skirt member 34, thereby maintaining the waterproof state.

The attachment groove 13 is formed is concave in the outer wall face 4A of the terminal housing member 4, and the sealing ring 14 is attached in a manner whereby it is fitted totally within the attachment groove 13, the outer circumference face 14B of the sealing ring 14 forming an approximately unified face with the outer wall face 4A of the terminal housing member 4. As a result, the fitting space 10 is exactly large enough to house the skirt member 34 of the corresponding connector 30, and there is no need to provide any space to accommodate the thickness of the sealing ring 14. Consequently, the sealing ring 14 is attached without increasing the outer diameter of the fitting space 10, thereby allowing the waterproof connector 1 to be miniaturized. Furthermore, there is no surplus space within the fitting space 10 corresponding to the thickness of the sealing ring 14.

Figure 7:
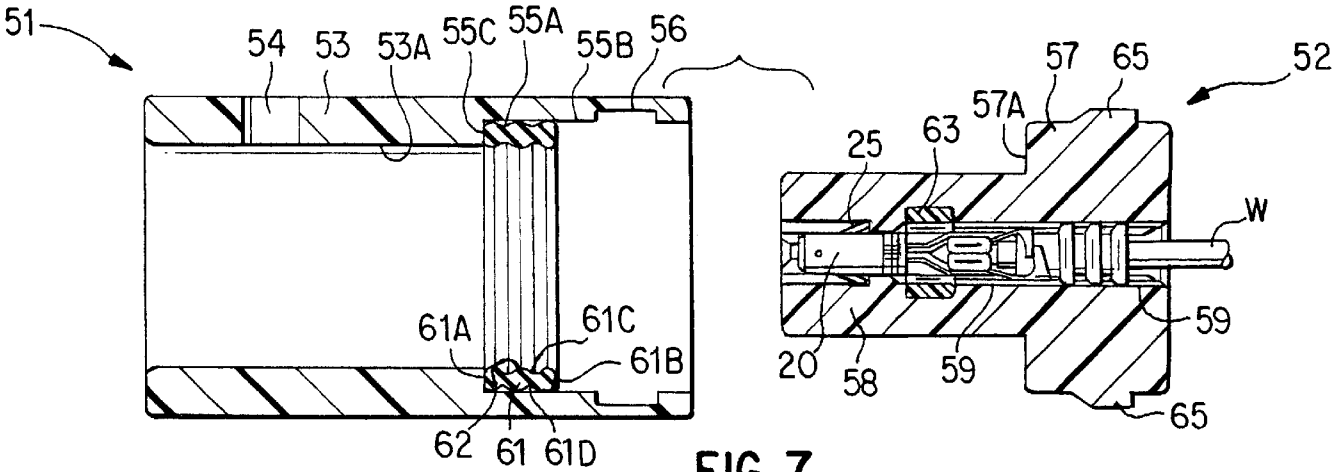
FIG. 7 is a disassembled side cross-sectional view of a waterproof connector of a second embodiment.
Figure 8:
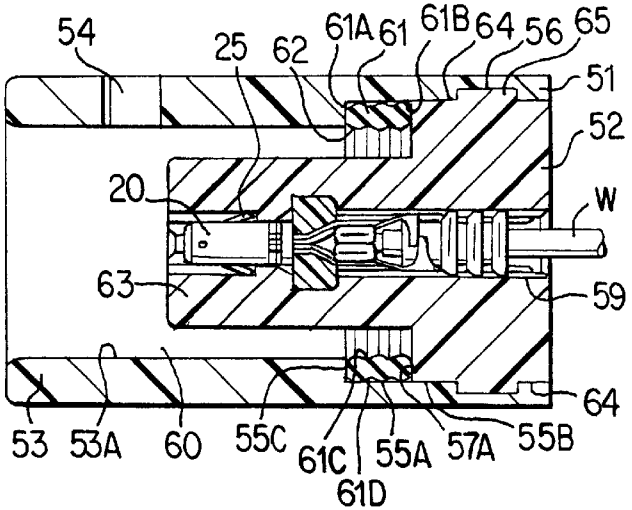
FIG. 8 is a side cross-sectional view of the waterproof connector of the second embodiment in a joined state.
Figure 9:
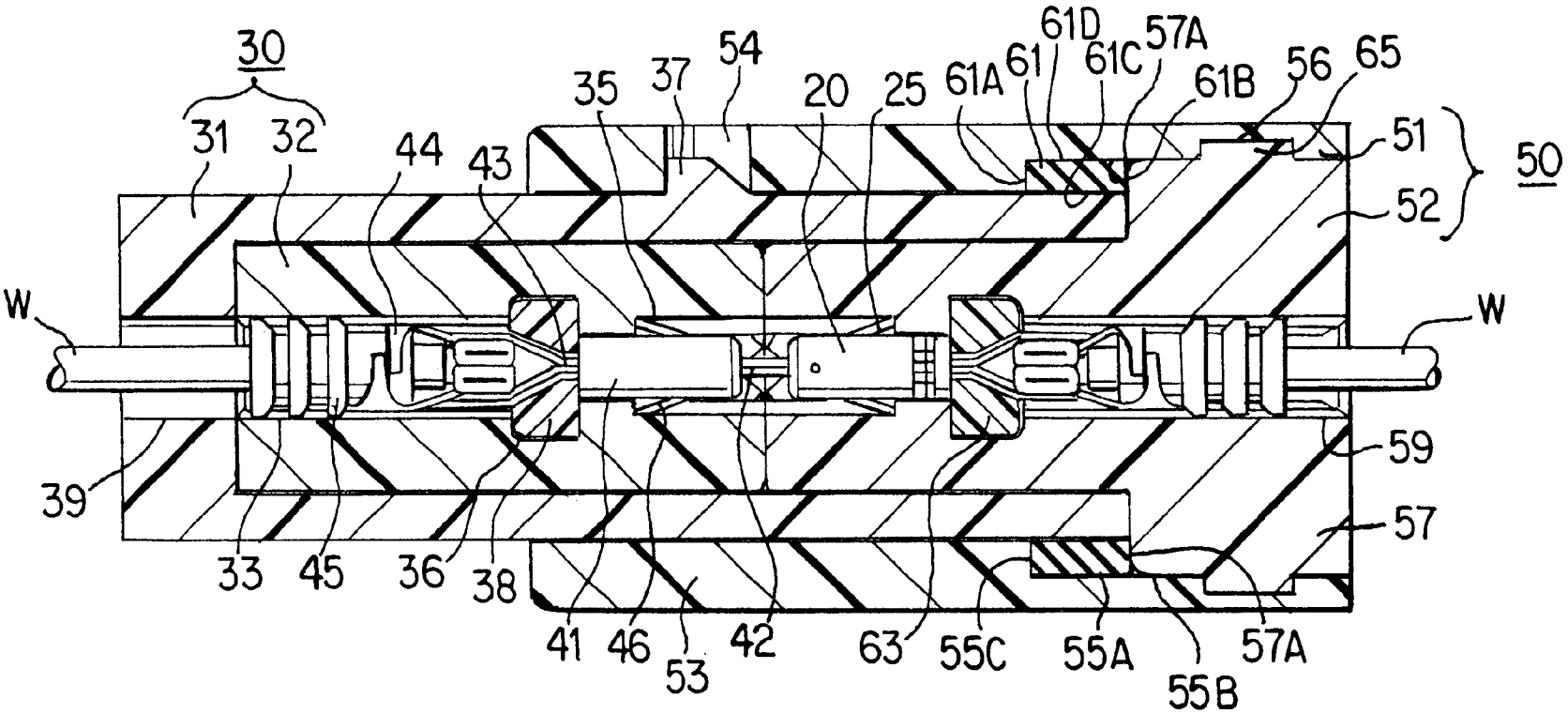
FIG. 9 is a side cross-sectional view of the waterproof connector of the second embodiment and the corresponding connector in a fitted state.
Figure 10:
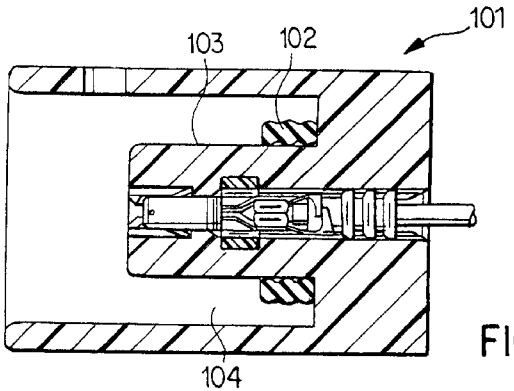
FIG. 10 PRIOR ART
FIG. 10 is a side cross-sectional view of a prior art waterproof connector.
Figure 11:
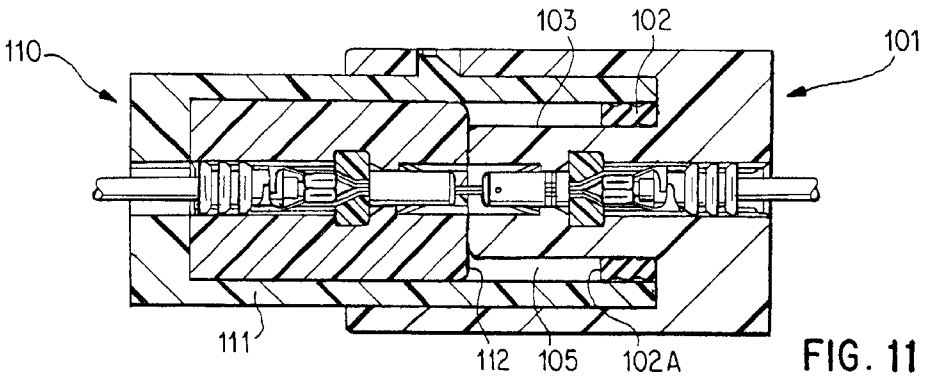
FIG. 11 PRIOR ART
FIG. 11 is a side cross-sectional view of the prior art waterproof connector and a corresponding connector in a fitted state.

A second embodiment of the present invention is described below with the aid of FIGS. 7 to 9.

An outer housing 51 of a waterproof connector 50 has an approximately tubular shape and both ends in the anterior-posterior direction are open. An anterior end portion of the outer housing 51 forms a hood 53 capable of housing a corresponding connector 30. A housing recess 55B is formed in an inner wall face 53A of a posterior end portion of the outer housing 51, this recess member 55B being wider in diameter than the inner wall face 53A. A flange member 57 formed on an inner housing 52 (to be described) is housed within this housing recess 55B. A pair of retaining holes 56 are formed in upper and lower faces of the recess 55B.

A portion of the recess 55B located slightly to the anterior of a step 55C forms an attachment groove 55A into which a sealing ring 61 is fitted. The sealing ring 61 is made from a resilient material such as rubber and has a ring shape. An inner circumference face 61C of the sealing ring 61 forms an approximately unified face with the inner wall face 53A of the hood 53. Furthermore, a plurality of lips 62 are formed on the inner circumference face 61C of the sealing ring 61 and on an outer circumference face 61D thereof.

The inner housing 52 has a tubular shape, a posterior end portion thereof being provided with the flange member 57. The cross-sectional dimensions of this flange member 57 are such that it fits exactly into the recess 55B. A pair of retaining protrusions 65 are provided on upper and lower faces of the flange member 57, these engaging with the retaining holes 56 of the outer housing 51. As in the case of the first embodiment, the inner housing 52 has a terminal housing member 58 provided therein, this terminal housing member 58 being housed within the skirt member 34 of the corresponding connector 30. The female terminal fitting 20 is housed within a cavity 59 formed in the terminal housing member 58.

The configuration of the female terminal fitting 20 and of the corresponding connector 30 is the same as in the first embodiment, and consequently an explanation thereof is omitted.

As in the case of the first embodiment, when the waterproof connector 50 is to be assembled, the female terminal fitting 20 is inserted into the cavity 59 and is doubly retained by the lances 25 and a side retainer 63. Next, the sealing ring 61 is fitted into the attachment groove 55A of the outer housing 51. Since the portion of the recess 55B in the vicinity of the step 55C forms the attachment groove 55A, and this recess 55B is open to the posterior, the sealing ring 61 can easily be attached to the attachment groove 55A.

Next, the inner housing 52 is attached from the posterior to the outer housing 51. The inner housing 52 is pushed inwards, an anterior end 57A of the flange member 57 causing the sealing ring 61 to be compressed in an anterior-posterior direction as this occurs, until the inner housing 52 has reached a correct joining position within the recess 55B. The retaining protrusions 65 engage with the retaining holes 56, this maintaining the inner housing 52 in an unremovable state. By this means, the sealing ring 61 is maintained in a gripped manner between the anterior end 57A of the flange member 57 of the inner housing 52 and the step 55C of the outer housing 51. That is, the joining operation of the inner housing 51 is used to fix the position of the sealing ring 61.

When the two housings 51 and 52 are in a joined state, a fitting space 60 is formed in the space between the anterior portion of the inner housing 52 and the hood 53. The skirt member 34 of the corresponding connector 30 can be fitted into this fitting space 60.

When the waterproof connector 50 is fitted to the corresponding connector 30, the skirt member 34 of the corresponding connector 30 is inserted into the fitting space 60 of the waterproof connector 50. As shown in FIG. 9, after the two connectors 50 and 30 have been correctly fitted together, the male and female terminal fittings 20 and 40 make contact, and a locking member 37 of the corresponding connector 30 is engaged with a groove member 54 of the waterproof connector 50, this maintaining the two connectors 50 and 30 in an unremovable state. Furthermore, the lips 62 on the inner circumference face 61C and the outer circumference face 61D of the sealing ring 61 are pushed resiliently against the attachment groove 55A and the inner wall face of the skirt member 34, thereby maintaining the waterproof state.

The sealing ring is attached in a manner whereby it is fitted totally within the attachment groove 55A of the outer housing 51. Consequently, as in the case of the first embodiment, the waterproof connector 50 can be miniaturized. Furthermore, there is no surplus space within the fitting space 60 corresponding to the thickness of the sealing ring 61.

The sealing ring 61, which is attached within the attachment groove 55A, is compressed in an anterior direction by the anterior end 57A of the flange member 57. As a result, not only the inner circumference face 61C and the outer circumference face 61D of the sealing ring 61 are pressed strongly against the housing, so too are an anterior end face 61A and a posterior end face 61B thereof. Consequently, water is prevented from entering via a joining face 64 located between the inner housing 52 and the outer housing 51, and the interior of the waterproof connector 50 is reliably waterproofed.

Furthermore, the present invention is not limited to the embodiments described above with the aid of figures. For example, the possibilities described below also lie within the technical range of the present invention. In addition, the present invention may be embodied in various other ways without deviating from the scope thereof.

(1) In the embodiments described above, the waterproof connectors 1 and 50 are formed from separate inner housings 3 and 52, and outer housings 2 and 51. However, according to the present invention, the waterproof connector may equally well have a configuration whereby it is formed in a unified manner.

(2) The waterproof connectors of the embodiments described above employ side-type retainers 16 and 63. However, the present invention is equally suitable for a waterproof connector employing a retainer attached from the posterior of the housing, this being inserted into the cavity and directly retaining the terminal fitting.

(3) The sealing rings 14,61 are described as separate components in the embodiments described above. However, these sealing rings could be co-moulded in respective recesses.

What is claimed is:

1. A waterproof connector comprising a hood, a terminal accommodating member adapted to house a terminal fitting and insertable into said hood, said accommodating member and hood defining a fitting space formed between said hood and accommodating member, a corresponding connector having a tubular mouth being insertable into said fitting space, and an annular waterproofing member being provided at said fitting space, one of the inner and outer circumferential faces of said waterproofing member forming a sealing face with the corresponding connector wherein one of an inner wall face of said hood and an outer wall face of said accommodating member is provided with a recess to house said waterproofing member, and a thickness of the tubular mouth corresponds to the height of the fitting space such that the tubular mouth is in contact with the inner wall face of said hood, the outer wall face of said accommodating member and the sealing face of the waterproofing member when the corresponding connector and the waterproof connector are fitted together.

2. A connector according to claim 1 wherein said hood includes a latching recess and said corresponding connector includes a projection latchable in said latching recess to retain said connector and corresponding connector in an engaged condition.

3. A connector according to claim 1 wherein said waterproofing member is accommodated in said recess without clearance.

4. A connector according to claim 1 wherein said waterproofing member includes circumferentially extending lips to improve sealing thereof.

5. A connector according to claim 1 wherein said fitting space is annular and said waterproofing member is annular.

6. A connector according to claim 5 wherein said recess comprises an annular groove.

7. A connector according to claim 6 wherein said groove is provided on said accommodating member.

8. A connector according to claim 1 wherein said accommodating member is latchable within said hood.

9. A connector according to claim 7 wherein said hood is tubular.

10. A connector according to claim 8 wherein said waterproofing member comprises a resilient seal having a rectangular cross-section, the side faces of said waterproofing member being exposed for respective contact with said accommodating member and said hood.

11. A connector according to claim 10 wherein said recess is provided in said hood.

12. A connector according to claim 9 wherein said waterproofing member comprises a resilient seal having a rectangular cross-section, the side faces of said waterproofing member being exposed for respective contact with said accommodating member and said hood.

13. A connector according to claim 12 wherein said recess is provided in said hood.

14. A waterproof connector comprising a hood, a terminal accommodating member adapted to house a terminal fitting and insertable into said hood at a posterior end of said hood, said accommodating member and hood defining a fitting space formed between said hood and accommodating member, a corresponding connector having a tubular mouth being insertable into said fitting space at an anterior end of said hood, and an annular waterproofing member being provided at said fitting space, one of the inner and outer circumferential faces of said waterproofing member forming a sealing face with the corresponding connector, wherein one of an inner wall face of said hood and an outer wall face of said accommodating member is provided with a recess to house said waterproofing member.

* * * * *